US006325726B2

(12) United States Patent
Helstrom

(10) Patent No.: US 6,325,726 B2
(45) **Date of Patent: *Dec. 4, 2001**

(54) WINTER GOLF DRIVING RANGE

(76) Inventor: Jeffrey C. Helstrom, 8276 Scandia Rd., Waconia, MN (US) 55387

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,339

(22) Filed: Apr. 23, 1999

(51) Int. Cl.[7] ..... A63B 69/36
(52) U.S. Cl. ..... 473/168
(58) Field of Search ..... 473/167–170

(56) References Cited

U.S. PATENT DOCUMENTS

| | | | | |
|---|---|---|---|---|
| 1,745,201 | | 1/1930 | Alston . | |
| 2,043,273 | | 6/1936 | Watson . | |
| 2,805,070 | | 9/1957 | Waters . | |
| 3,231,280 | | 1/1966 | Collins . | |
| 3,310,310 | | 3/1967 | McKee . | |
| 3,464,703 | | 9/1969 | Vallas . | |
| 3,504,912 | * | 4/1970 | Jenney | 473/168 |
| 3,599,980 | | 8/1971 | Harmond et al. . | |
| 3,649,025 | | 3/1972 | Garland . | |
| 3,797,827 | * | 3/1974 | Child | 473/168 |
| 3,861,680 | | 1/1975 | Mowrer . | |
| 4,750,744 | | 6/1988 | Michalec . | |
| 5,011,152 | | 4/1991 | Hugunin . | |
| 5,265,875 | * | 11/1993 | Fitzgerald | 473/169 |
| 5,547,186 | | 8/1996 | Papp et al. . | |

* cited by examiner

*Primary Examiner*—Mark S. Graham
(74) *Attorney, Agent, or Firm*—Haugen Law Firm PLLP

(57) ABSTRACT

An all weather golf driving range which is designed to drape and or cover a conventional range with a netting having a number of ball receiving bores formed therein to permit balls to be conveniently and automatically collected through motion induced by gravity from the configuration of the netting. When in position, the netting is configured in its elevation by the plurality of conical members, preferably in reticulated form, with ground support posts holding the netting up to form apices, and with the ball receiving bores being formed at the lower juncture points along or at the mutually adjacent conical zones.

2 Claims, 3 Drawing Sheets

WINTER GOLF DRIVING RANGE

BACKGROUND OF THE INVENTION

1. Field of the Invention

Outdoor golf driving ranges are popular recreational gathering or congregation spots for those interested in either improving their golf game or simply hitting some golf balls as a way of relaxing. In climates where late fall or winter brings with it snow and cold weather, a typical outdoor golf driving range will be forced to close for the duration of the inclement weather season for any number of reasons, the least of them being other than the presence of snow on the ground. During the summer, outdoor golf driving range operators can, in a fairly efficient fashion, collect driven or hit balls either by hand or through the use of various self-propelled mechanical devices. In the winter, snow and cold and/or miserable weather conditions make most conventional-collection methods impossible or at least impractical since a hit ball may be lost in several inches or more of snow and/or ice. Further, the presence of accumulated snow makes the use of most conventional mechanical collection devices impractical. Additionally, the presence of snows hinders manual collection in at least two ways. First, since the ball may be buried in snow, in whole or in part, the ball may very well be difficult to spot from above even if it is of a contrasting or different color than the snow. Secondly, the very fact that snow is on the ground will, doubtlessly, either hinder or make it impossible for the collector to locate the balls. Accordingly, it is a principle objective of this invention to provide a golf driving range which is usable during the snowy and inclement weather months, and which allows for the efficient retrieval of hit balls by the range operator.

2. Description of the Prior Art

In the past various techniques have been utilized for providing indoor all-season golf facilities. While enclosed air-inflated domes have been utilized, they nevertheless provide limitations in size which, in turn, restricts the golfer in his ability to observe the projectory of the ball beyond the limits of the dome-size. The economics of the situation are such that it is impractical and financially unsound to utilize an inflatable dome structure which is large enough to eliminate the limitation and constraint of size.

Additionally, in U.S. Pat. No. 3,861,680, there is disclosed a system which provides for some limited utilization of a cold weather golf driving and/or practice range. The system disclosed in U.S. Pat. No. 3,861,680 utilizes a series of inverted "v" screens which carry yardage indicia, and which are necessarily positioned as a embutment plate or barrier for substantially free flight of the ball to a landing point. The system disclosed presents some difficulties in ball retrieval, particularly when considering the inherent limitations of dimensional configuration. The arrangement of the present invention eliminates these disadvantages and provides a golf practice facility which may be utilized all year-round in areas where climatic conditions result in harsh winters.

SUMMARY OF THE INVENTION

In accordance with the present invention, a golf practice driving range and facility which utilizes a heated open-ended enclosure for accommodating the golfer particularly in cold and/or inclement weather is revealed. The field is essentially unlimited in size and configuration, being conveniently placed on an existing golf fairway, and for ball retrieval purposes is covered with a plurality of elevated zones shaped generally as pentahedrons having a bottom or base surface which at least partly open. While not being essential or critical, the configuration is such that an arrangement or pattern of generally upright posts is provided for creating the pentahedrons, and thus creating a means for cheating gravity flow and movement of golf balls to a temporary collection and/or transfer point. The covering surface is preferably in the form of plastic film netting or reinforced scrim-like material which may be perforated with openings sufficiently small dimensions so as to reduce any interference with the free movement of the ball across the surface toward a ball retrieval opening.

Although the size and configuration of the installation is virtually unlimited, it is appreciated that the installation can be achieved and accomplished without the need for extensive grading or reworking of the earth or ground, thereby being environmentally friendly and ecologically sound. The installation is straightforward and the general configuration of the terrain of the base is replicated in the covering surface.

BRIEF DESCRIPTION OF THE DRAWINGS

Referring now to the General Description drawings, FIG. 1 shows the driving range generally designated 10 of the present invention, including a ground-covering area-wide net 12 which is supported by a network or plurality of cables 14 disposed in an x-y pattern. Cables 14 stand anywhere from 5 to 12 feet off of the surface of the ground. The cables 14, in turn, are secured or otherwise affixed to posts 16 and are maintained under tension so as to provide a reticulated generally open planar surface to which the net 12 can be attached. The net 12 is attached to the cable 14 through the use of spaced clips, rollers, tie points, or any other known means or methods of affixation as illustrated in the drawings.

Figure 1:
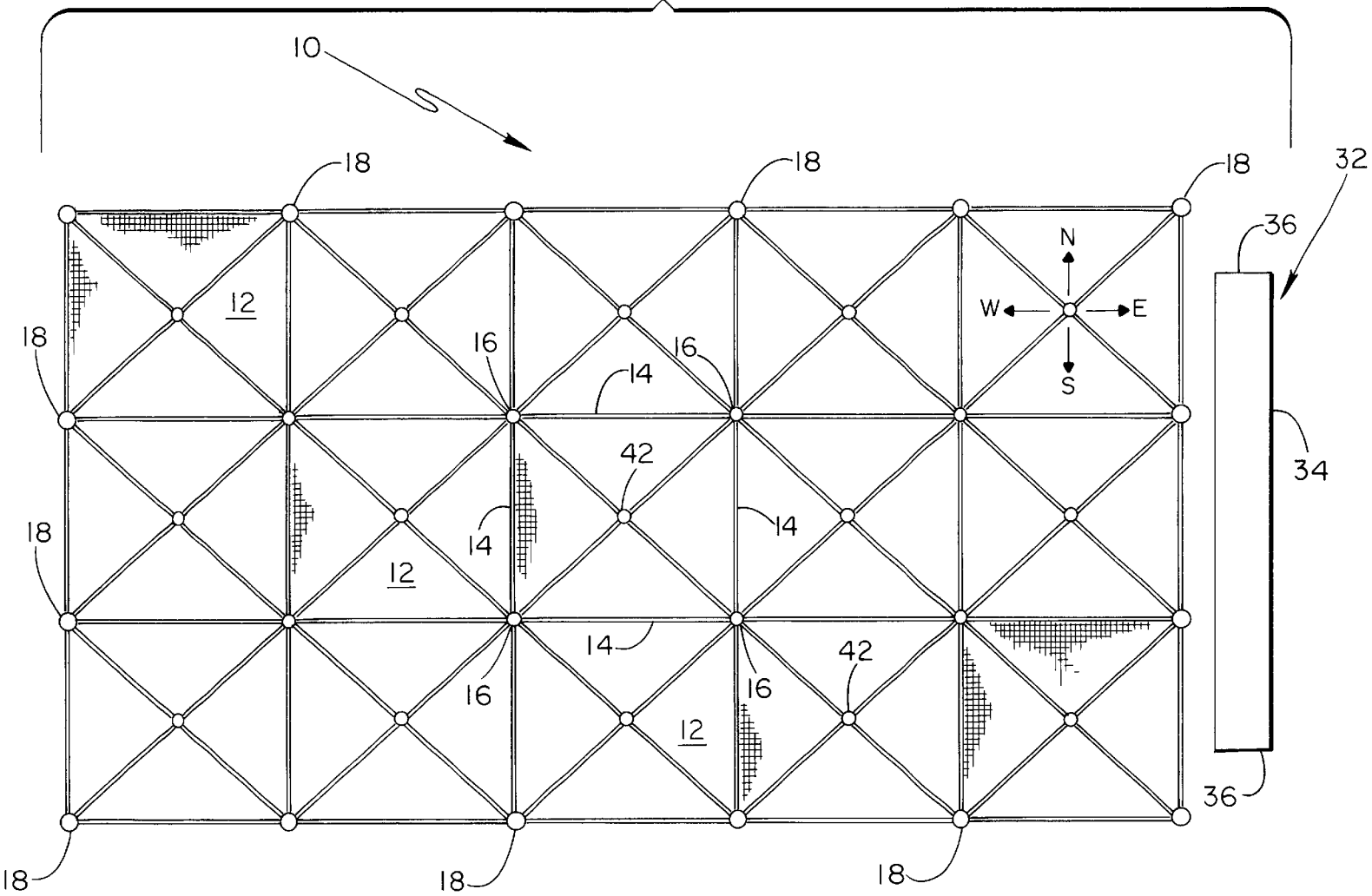
FIG. 1 is a top plan view of a typical driving range arranged and constructed in accordance with the invention.

Around the exterior of the driving range, a series of elongated or high perimeter posts 18 are positioned, with these posts supporting a 50 foot high section of vertically disposed ball impermeable netting 20 which extends around and surrounds the perimeter of the entire range 10. This netting 20 serves the dual purpose of defining the range edges while insuring that erantly hit balls are kept within the confines of the range and not lost in the snow, thus as serving to protect people and property which otherwise may be struck by hooked, sliced or otherwise erantly hit balls. The netting 20 is affixed or suspended from section of cable 30, the spans of which typically stand at about 50 feet off the ground. These cables 30, like cables 14, are attached to a series of posts and define catenary netting suspending sections. It should be noted that the height of these cable spans may be of my desired distance from the ground with about 50 feet having been found to be desirable.

BRIEF DESCRIPTION OF THE PREFERRED EMBODIMENT

With a continued attention being directed to FIG. 1 of the drawings, it will be noted that the range 10 includes a plurality of spans of cable 14-14 arranged in a grid-like X-Y pattern. Netting 12 covers the grid pattern to form the base of the driving range per se. The exterior or perimeter of the range, is indicated above, defined by netting 12 suspended from individual catenary spans of perimeter defining cable 20. A three-sided shelter is shown generally at 32, with the interior zone being equipped with heating elements such as radiant panels or the like. Wind and weather-proof exterior is provided along the back panel 34 and also end panels 36-36. A roof is, of course, provided from which the heating panels are preferably suspended, and a floor surface is provided to accommodate and support the golfers utilizing the facility, and also to provide a suitable array of T-boxes. Such shelters or enclosures are known in the art, and in particular ail in wide spread use as personnel shelters in urban areas.

Figure 2:
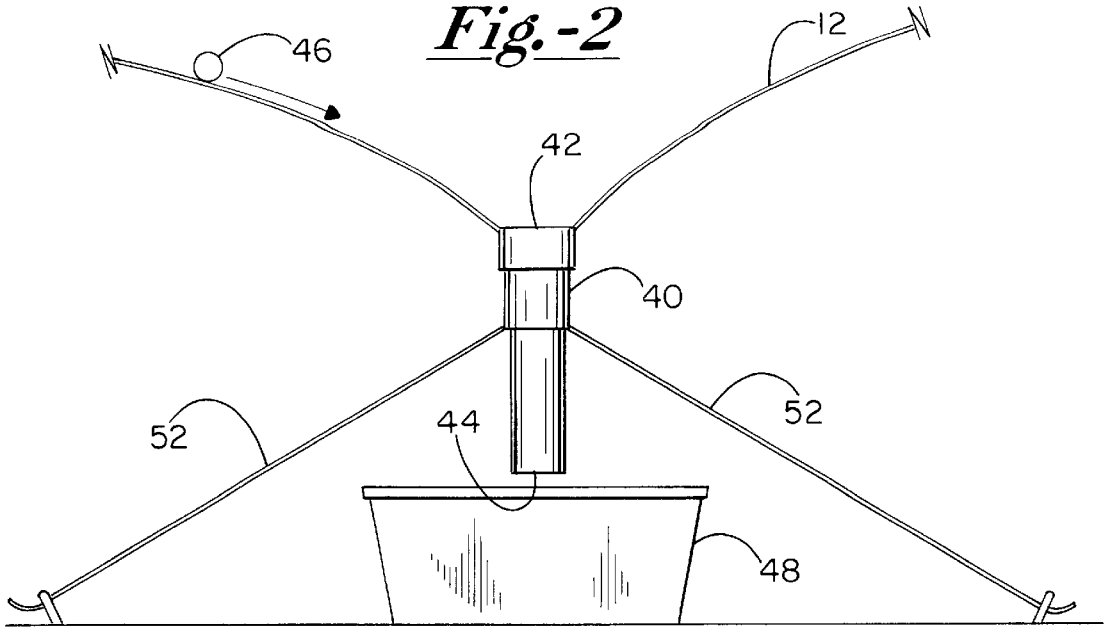
FIG. 2 is a detail elevational view on a highly enlarged scale of ball collection portion or component constructed in accordance with one aspect of the present invention with the net being cut away and shown in fragmentary form.

With attention now being directed to FIG. 2 of the drawings, a fragment section of netting 12 is illustrated, together with a ball receiving conduit member 40. Conduit 40 is, of course, open and extends from ball receiving mouth 42 to ball discharge end 44. Suitable attachment means are employed, such as clamps for the pike in order to secure net 12 to the edges of conduit 40 adjacent balls 42. A golf ball hit by a golfer into the range, and striking the netting between the individual grid patterns is illustrated as at 46, with the ball falling by gravity along the surface of netting 12 into opening 42 and ultimately being discharged at end 44 into a buffer receiving box or other open-top enclosure as at 48. As can be seen in the drawings, individual conduits 42-42 are spread and distributed throughout the grid-like pattern of cable members 14-14, and thus serve to continuously collect, retrieve, and otherwise receive golf balls struck by the users of the facility. Individual buffer receptacles such as at 48-48 are periodically emptied either automatically or by hand. One technique of providing a continuous flow of balls would be to attach individual buffer receptacles 48-48 together in a chain-like fashion, and periodically move or advance the train of receptacles in a draw-fashion, thereby providing and maintaining the system with a modest requirement for ball supply.

Figure 3:
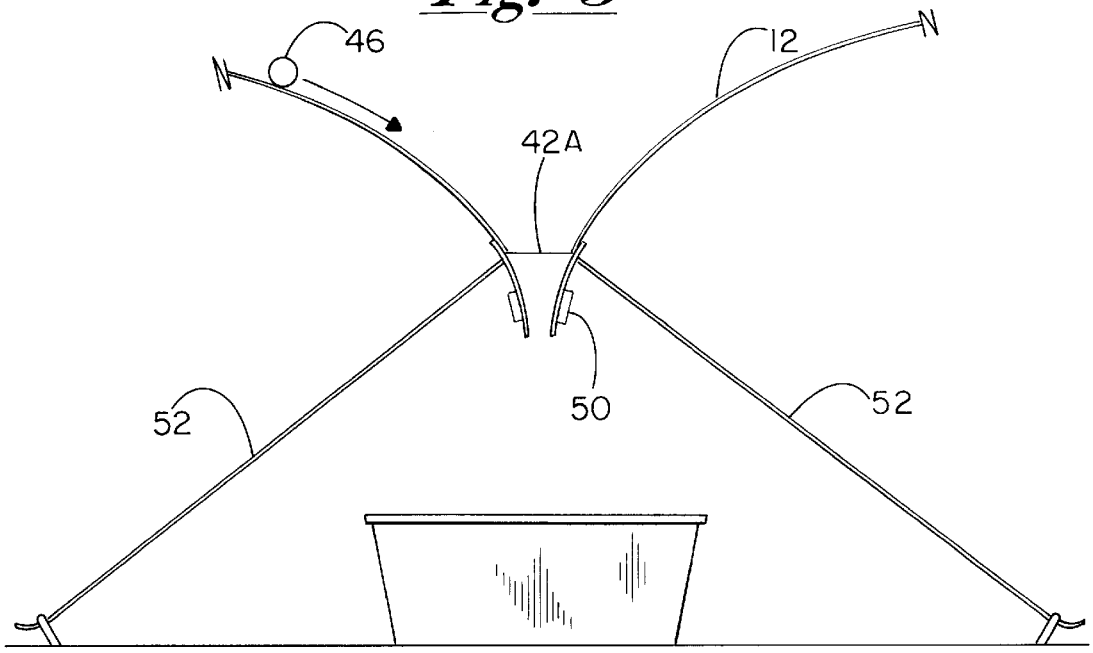
FIG. 3 is a detail elevational view similar to FIG. 2 of a modified form of the ball collection section constructed in accordance a modified form of the present invention.

With attention now being directed to FIG. 3 of the drawings, a modified configuration of ball retrieval devices is illustrated. In this arrangement, an opening 42A is provided in the netting 12, with a weighted member 50 being provided, is indicated, in order to form the reticulated three dimensional pattern with appropriated slope to cause balls 46 to move by gravity toward opening 42A. Should it be desirable or necessary to provide a greater drop in along the Z-access, tie-down members as at 52-52 may be utilized in order to draw netting 12 downwardly. This feature is also illustrated in FIG. 2 and is utilized whenever the weight of conduit 40 or other member is insufficient to provide the desired drop.

Figure 4:
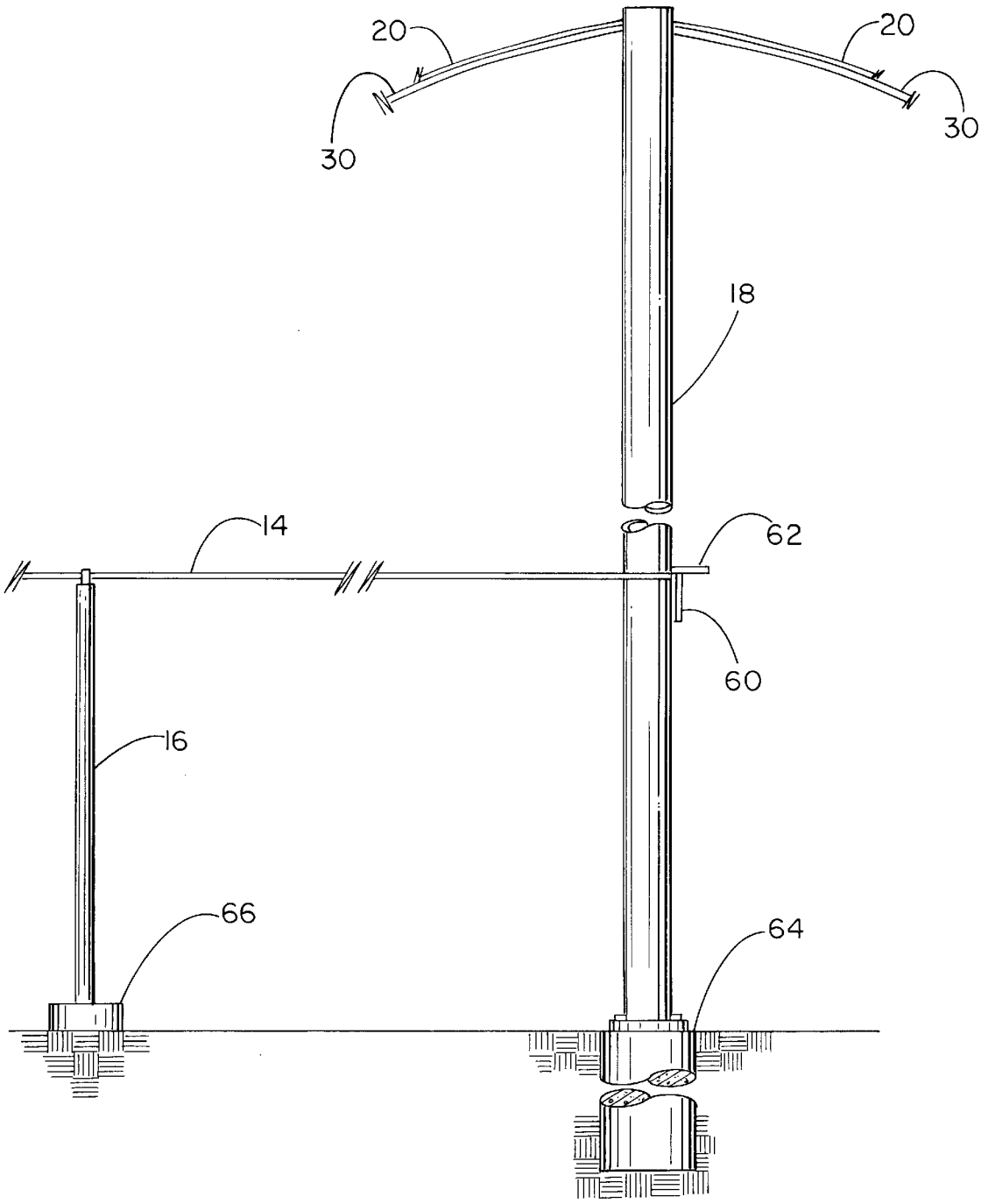
FIG. 4 is a side elevational view of a typical permanent vertical net support pole and a typical internal horizontal net support post and anchoring means, together with a cable of the type which extends between the permanent net support poles, illustrating the attachment of a cable winch tensioner on the permanent vertical net support pole.

With attention now being directed to FIG. 4, perimeter posts as illustrated at 18 are employed to support and otherwise suspend perimeter cable 20 about the periphery of the range. In a typical installation, poles 18 will be approximately 50 feet high. In one installation, poles 18-18 are 14 inches in diameter ASTM 53 GR material having a wall thickness of 0.375 inches. Poles 18 support a winch or cable retainer as shown at 60, with winch 60 having a hand gripping actuating handle as at 62. Those winches typically utilized for boats or other similar heavy duty purpose have been found satisfactory. When installed in a typical installation, perimeter support poles 18-18 are normally spaced 60 feet on center.

With regard to the internal net supporting posts 16-16, these posts are typically elevated approximately at a recommended height 12 feet above grade, and are fabricated from three to ten inch diameter schedule 40 pipe. Suitable base supports are, of course, placed as required for the perimeter poles 18-18 as well as the interior posts 16-16. The nature of the earth and ground support will, of course, determine the base support necessary, and this is readily determined by local mechanics working within the community and familiar with the ground support requirements. A typical subterrainium support member is shown at 64 for the perimeter poles will be sunk to a depth of 14 feet and be formed of 30 inch diameter concrete with appropriately spaced vertical ties at least as close as 12 inches center. The interior posts are preferably supported by 2 foot diameter pads, typically concrete reinforced with appropriate mesh, and being about 8 inches in thickness. Such a pad is illustrated at 66. In a typical installation, the reticulated pattern of interior posts 16-16 utilized a spacing of 60 feet on center in the longitudinal direction, and 50 feet on center for the transverse dimension. In the illustration of FIG. 1, the transverse direction is shown as north-south, with the longitudinal dimension being shown at east-west, this being, of course, merely by way of example.

In a typical installation, ⅜ inch diameter steel cable is employed for cables 14, with the maximum tension in the cables being preferably maintained at about 1000 pounds. As indicated in FIG. 4, this tension is created and maintained by winch 60.

It will be appreciated, of course, that the details of this preferred embodiment are given for purpose of illustration only, with the scope of the invention being defined by the appended claims.

What is claimed is:

1. An all-weather golf driving range comprising, in combination:

(a) a golf range having golf ball hitting and landing zones and defining a golf hole fairway, with said hitting zone being positioned along a first of two opposed ends of said fairway;

(b) a primary array of posts including elongated pole means circumscribing a perimeter of said golf fairway and with pairs of said elongated poles being disposed in oppositely disposed relationship between opposed first and second ends and along the lateral edges of said perimeter;

(c) a secondary array of posts comprising support posts which are relatively shorter than said primary array of posts, and are disposed in spaced reticulate relationship between said primary array of posts and within said golf fairway, each of said secondary posts having a first predetermined height and being positioned to define a reticulated pattern;

(d) a plurality of tensioned cable means extending across said fairway between mutually opposed primary posts above said fairway surface, the opposed ends of said tensioned cable means being grasped by tensioning means disposed on said primary posts at a predetermined height which is at least equal to said first predetermined height, said tensioned cable means and said secondary posts, in combination, forming a grid pattern in said fairway;

(e) at least one non-tensioned, caternary-forming cable extending between mutually adjacent primary posts above said fairway surface along at least a portion of said perimeter at a predetermined height which is greater than said first predetermined height;

(f) a golf ball supporting net supported by and attached at its edges to said primary posts, and affixed to said tensioned cable means and being further supported by said secondary posts at said first predetermined height, said net being drawn taut against top portions of said secondary posts by downward-pulling tie means such that said supporting net forms a plurality of conical apices, said net including at least one golf ball receiving opening formed at a mutual junction point between said cones;

(g) a perimeter-defining vertically disposed net suspended from said non-tensioned, caternary-forming cable; and (h) a golf ball retrieval means positioned beneath each of said golf ball receiving openings.

2. An all-weather driving range as defined in claim 1 particularly characterized in that said golf ball hitting zone is a heated, inclement weather-proof comfort shelter, disposed along and adjacent to said first opposed edge of said golf fairway.

* * * * *